United States Patent [19]

Doty

[11] 4,283,661

[45] Aug. 11, 1981

[54] IRRADIATION DEVICE AND REMOVABLE TIMER USEFUL THEREWITH

[75] Inventor: Wendell E. Doty, Battle Creek, Mich.

[73] Assignee: Battle Creek Equipment Co., Battle Creek, Mich.

[21] Appl. No.: 124,259

[22] Filed: Feb. 25, 1980

[51] Int. Cl.[3] ..... H05B 37/02; H05B 41/36

[52] U.S. Cl. ..... 315/360; 315/122; 315/129; 307/141.4; 128/396

[58] Field of Search ..... 315/360, 362, 120, 122, 315/129; 307/141, 141.4; 128/395, 396

[56] References Cited

U.S. PATENT DOCUMENTS

| | | | |
|---|---|---|---|
| 2,716,698 | 8/1955 | Brukner | 315/360 |
| 2,954,771 | 10/1960 | Boyan | 315/360 |

*Primary Examiner*—Alfred E. Smith
*Assistant Examiner*—Thomas P. O'Hare
*Attorney, Agent, or Firm*—Fisher, Gerhardt, Crampton & Groh

[57] ABSTRACT

An irradiation apparatus having a housing, a reflector and a source of ultraviolet radiation. The irradiation apparatus has a timing mechanism detachably located within the housing, the timing mechanism being an integral portion of the circuit which supplies power from a power source to the ultraviolet radiation source. The timer is adapted to be removed from the housing and attached to the housing by means of a cord having a non-standard plug to allow the lamp to be operated by means of the timer from a remote position.

6 Claims, 6 Drawing Figures

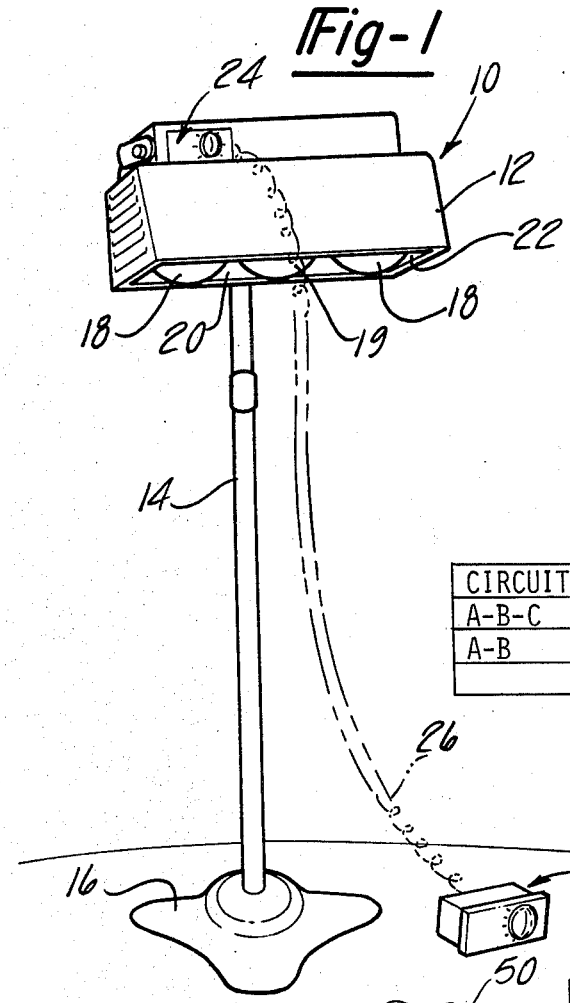
Fig-1
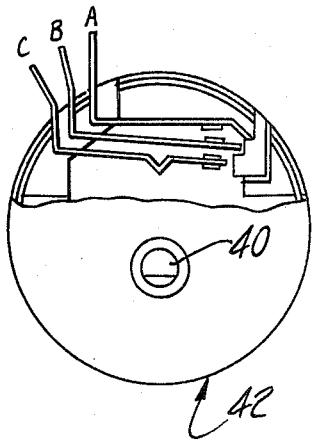
Fig-3
| CIRCUIT | | |
|---|---|---|
| A-B-C | | |
| A-B | | |
Fig-4
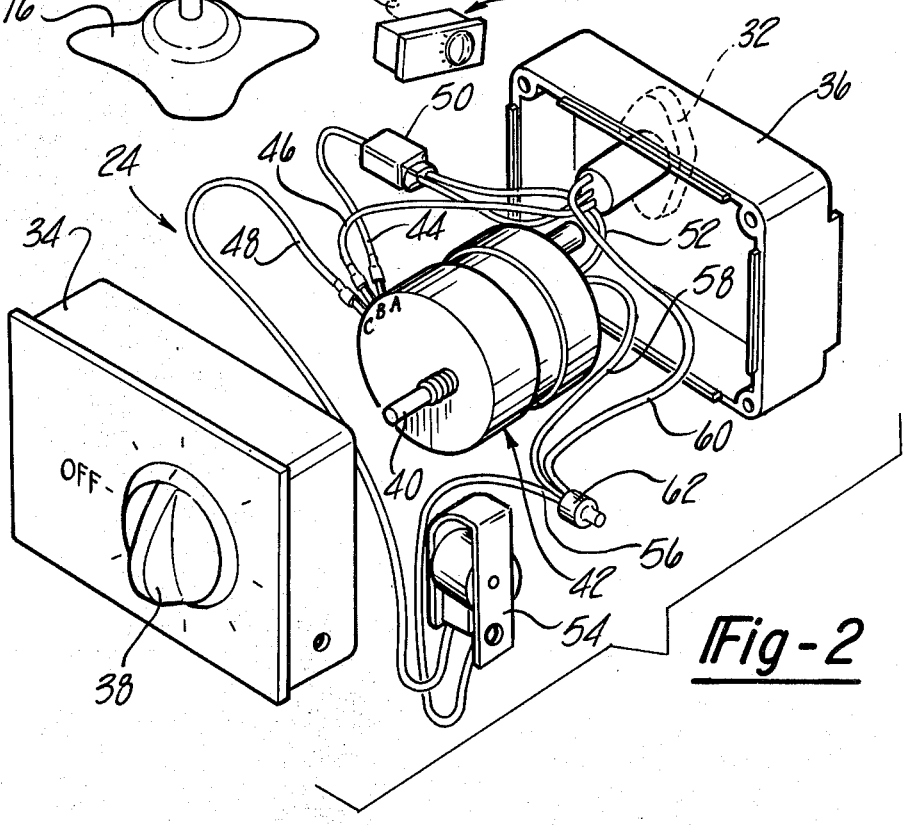
Fig-2

IRRADIATION DEVICE AND REMOVABLE TIMER USEFUL THEREWITH

The use of ultraviolet radiation alone or in combination with infrared radiation is well known for treating humans. In using such devices, it is the usual course of treatment to gradually increase the dose of ultraviolet radiation applied to the person being treated over a number of days. This is generally accomplished by exposing the person to the radiation of the ultraviolet source for increasingly longer periods of time. Initially, for example, the radiation may only be applied to the area to be treated for a matter of a minute or two. While amounts of radiation up to on the order of ten minutes is suitable for people who are using the radiation simply to gain a minor amount of skin coloration, those people who are using ultraviolet radiation for the treatment of skin problems or to gain a deep tan frequently require increasingly longer periods of exposure in excess of ten minutes.

People using the longer periods of exposure have occasionally encountered problems. The warm soothing effect of such lamps is such that certain people have fallen asleep under the lamps resulting in an artificial sunburn and other similar problems. Therefore, it is desirable to limit the amount of time that the lamp can remain on without some form of intervention on the part of the person being exposed. To solve this problem it has been proposed to place a timing mechanism within the sunlamp so that the timer turns the lamp off after a predetermined, relatively short, period of time. For example, having the timer limit the exposure to ten minutes has proved a viable way to prevent overexposure.

While the installation of a timing mechanism prevents a sunlamp from being operated for extended periods of time, it presents a new problem for those people who require a longer exposure time than that allowed by the timer. Once ultraviolet lamps have been turned off, they require a considerable period of time to cool to room temperature before they can again be reactivated for additional exposure. Thus a timing mechanism which turns the lamp off before the exposure is finished necessitates a subsequent reexposure at a later time. Reexposure results in lost time and is discouraging to the person being treated.

It is an object of this invention to provide an ultraviolet radiation device which allows a substantial exposure if desired but simultaneously limits the time of exposure without an active intervention.

Briefly, the objects are achieved by the irradiation apparatus of the present invention which comprises a housing with an open portion and a reflector carried within said housing positioned to reflect radiation generated within the housing through the opening. A source of ultraviolet radiation is located within the housing. A timing mechanism is detachably located within the housing, the timing mechanism being an integral portion of the circuit which supplies power from a normal household power source to the ultraviolet source. An attachment means has a first end adapted to engage a complementary receptacle located within the housing and a second end adapted to engage a second complementary receptacle on said timer, said attachment means allowing said timer to be operatively connected to the circuit for providing power to the ultraviolet source at a location remote from the housing, to complete the circuit and allow operation of the lamp.

In the accompanying drawing,

FIG. 1 is a perspective view of a lamp according to this invention;

FIG. 2 is an exploded view of a timing mechanism useful in the practice of this invention;

FIG. 3 is a front view in partial cutaway of a timer motor and contacts of FIG. 2;

FIG. 4 is a time line operating diagram of the timer of FIG. 3;

Figure 6:
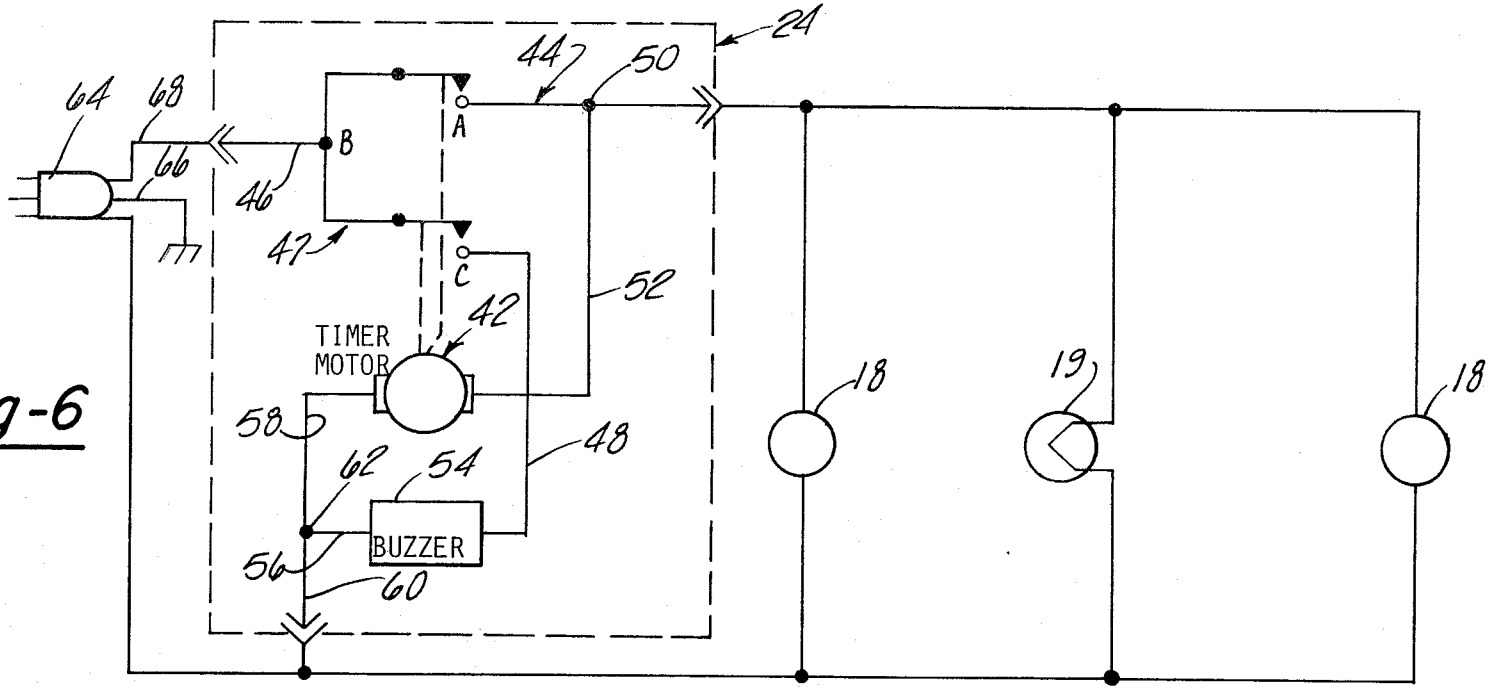
FIG. 6 is a block diagram of an electrical circuit useful in the practice of this invention.

Referring to the accompanying drawing and initially to FIG. 1, a sunlamp 10 has a housing 12 supported on a pole 14 and resting on a base 16, such a structure being well known in the art. The housing has receptacles (not shown) suitable for supporting one or more infrared bulbs 19 and ultraviolet bulbs 18 within the housing. The interior 20 of the housing can be made of reflectorized material to form a reflector which reflects the radiation from the interior of the housing out through an opening 22 in the housing. The housing 12 also has a timer mechanism 24 mounted within the housing and detachably connected thereto. As shown in phantom, the timer 24 can be removed from the housing 12 to a remote location and attached to the housing by means of an attachment cord 26.

Figure 5:
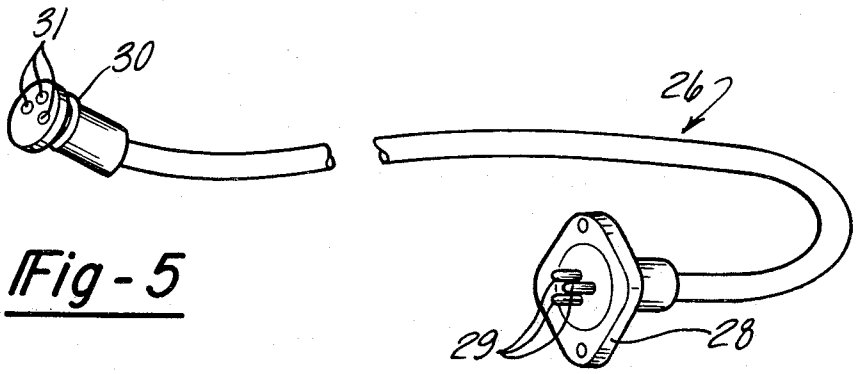
FIG. 5 is a perspective of a cord useful in the practice of this invention.

The attachment cord 26 is shown in greater detail in FIG. 5. The attachment cord has a first male plug 28 having three protuberances 29 and a female end 30 having three recesses 31. The female end is adapted to engage a corresponding male plug 32 on the timer mechanism 24, and the male end engages a corresponding female receptacle (not shown) in the housing. The attachment cord 26 provides a means for attaching the timer 24 to the housing while allowing the timer to operate in the normal manner. The plug 28 is shown with the three prongs or protuberances 29 in an off center arrangement making defeat of the lamp's timing circuit by means of a standard plug impossible. The off center, unsymmetrical arrangement also makes certain the plugs are properly arranged thereby ensuring that the timer is properly connected to the housing circuit.

Referring to FIG. 2, the timer 24 has a front housing member 34 which engages a rear housing member 36 to form a complete encasement for the timing components. The front of the housing has a dial 38 which engages a stem 40 extending orthoganally from a timer motor 42 through the housing member 34 and engages the dial in a manner well known in the art. The timer motor 42 has three attachment contacts A, B, C which are attached to corresponding electrical leads 44, 46 and 48. Contact A is connected by lead 44 to a tap connector 50 which provides a source of power both to the contact A and to the timer motor 42 by means of a line 52. Contact C connects the buzzer 54 to the timer motor; the buzzer 54, the timer motor 42 and the remainder of the system having the ground or white leads 56 joined together by a crimp cap 62.

The timer motor 42 can be a standard type well known in the art. For the purposes of description, it will be assumed that the motor is one which can be rotated almost one full turn to start and which would then rotate to the off position in about ten minutes. Longer or shorter periods could be chosen or a smaller angular travel could be chosen for the same time period, such choices being within the skill of the art. Also to be considered is the torque necessary to turn the dial in setting the motor since the dial will normally be manipulated by a person wearing protective lenses used to shield the eyes from the ultraviolet rays produced by the lamp.

FIGS. 3, 4 and 6 together show the contacts, the timer's operation and the circuit diagram used with the timer in greater detail. A source of power, such as an ordinary household outlet, is shown at 64 in FIG. 6 with a normal connection to ground at 66, grounding the lamp and circuit of this invention. The hot lead or black wire 68 is connected by means of one of the prongs of the male connector 32 to line 46 from the contact mechanism 47 which in turn causes the contact lever B (shown best in FIG. 3) to be energized with household current. When the timer 42 is activated, contacts B and A are closed forming a connection between lines 46 and 44, thus completing the circuit at the contact designated as A in FIG. 6. Closing the A-B contact allows current flow to the infrared bulb, shown as 19, and the ultraviolet bulbs, shown as 18. Simultaneously, current is applied to the timer motor 42 via the line 52 causing the timer motor to begin its timing sequence.

As shown in the diagram of FIG. 4, the timer motor, when set by turning it approximately 1 turn of the dial 38, begins to operate the circuit by closing the contact A and B thus lighting the lamps and running the timer motor simultaneously. The timer motor will continue to run continuously for a time of approximately 9 to 9½ minutes at which time the timer mechanism will activate contact C as well as A and B resulting in the buzzer 54 being connected to the circuit via line 48, sounding the buzzer. At this point, the person using the lamp will have a predetermined time in which to reset the timer motor for a longer exposure if desired. The length of time the buzzer is activated can be adjusted, times on the order of 10 to 30 seconds being sufficient for most purposes.

It is apparent from the foregoing description that a new and useful sunlamp and timing mechanism combination has been disclosed wherein the timing mechanism can be removed to a point remote from the lamp and attached to the lamp by means of a cord attachment.

In summary, the lamp can be used in the conventional fashion when the timing mechanism is inserted into the housing and can be operated by a person while in a prone or reclining position when the timing mechanism is attached to the lamp by the cord.

Various modifications and alterations of this invention will become apparent to those skilled in the art without departing from the scope and spirit of this invention; and it is to be understood that this invention is not limited to the illustrative embodiments set forth hereinbefore.

The embodiments of the invention in which an exclusive property or privilege is claimed are defined as follows:

1. An irradiation apparatus including: a housing having an opening; a reflector carried within said housing and positioned to reflect radiation within said housing through said opening; means for attaching said apparatus to a source of electrical current; an electrically powered source of ultraviolet radiation located within said housing; and a timing mechanism detachably located within said housing allowing removal of said timing mechanism from said housing, said timing mechanism being an removable and indispensable portion of the circuit between said attachment means and said source of ultraviolet radiation which supplies power to said ultraviolet source so that removal of said timer from said circuit renders said lamp inoperative even when said attachment means is connected to said source of electrical current.

2. That apparatus of claim 1 further comprising an attachment means having a first end adapted to engage a first complementary receptacle located within said housing and a second end adapted to engage a second complementary receptacle in said timer, said cord allowing said timer to be operated at a location remote from said housing to complete the circuit for said lamp.

3. The apparatus of claim 1 wherein said timer has a warning means associated therewith which will alert a user that the power circuit is about to be broken.

4. The apparatus of claim 1 wherein said timer can be reset to provide additional power to said lamp for an extended period after said warning signal and before said timer breaks said power circuit.

5. An irradiation apparatus comprising: a housing having an opening on one side thereof; an electrically powered source of ultraviolet radiation located within said housing and adapted to project radiation through said opening; means for attaching said apparatus to a source of electrical current; a first receptacle located within said housing, said receptacle having three contact points; a timer mechanism having an enclosure, complementary attachment means mounted on said enclosure, said attachment means adapted to engage the first receptacle of said timer and including a first prong which detachably engages a first aperture in said receptacle, the first prong providing a source of electrical current into said timer mechanism, a second prong which detachably engages a second aperture in said receptacle, said second prong providing a path for current from said timer mechanism to the source of ultraviolet radiation, a third prong which detachably engages a third aperture in said receptacle, said third prong providing a connection to the ground portion of the circuit which provides power to the ultraviolet source, a warning signal located within said enclosure, a timing motor located within said enclosure, a first electrical contact connected to said first prong, a second electrical contact connected to said second prong and also electrically connected to said timer motor, a third electrical contact electrically connected to said warning signal, said timing motor being adapted to engage said first and second electrical contacts when activated thereby completing the circuit to energize the ultraviolet source, and further being adapted to engage all three contacts a predetermined length of time prior to the point at which the power circuit through the first and second contacts is to be broken thereby sounding the warning signal to allow resetting the timer motor to prevent the power circuit being broken and allow additional exposure, said timing mechanism being removable from said housing and also being an indispensible portion of the circuit which carries current from its source of electrical current to said ultraviolet source.

6. The irradiation apparatus of claim 5 further comprising a cord having a first attachment means adapted to engage the prongs of said timer mechanism and a second attachment means adapted to engage the receptacle within said housing, said cord providing a means for said apparatus to be operated from a location removed from said lamp.

* * * * *